United States Patent [19]

Slusser

[11] 4,355,851

[45] Oct. 26, 1982

[54] DRAWER INTERLOCK SYSTEM

[75] Inventor: Boyd C. Slusser, Overisel, Mich.

[73] Assignee: Herman Miller, Inc., Zeeland, Mich.

[21] Appl. No.: 211,352

[22] Filed: Nov. 28, 1980

[51] Int. Cl.[3] ..... E05B 65/46; E05C 7/06

[52] U.S. Cl. ..... 312/215; 312/217; 312/220; 312/221; 312/222

[58] Field of Search ..... 312/215, 216, 217, 218, 312/219, 220, 221, 222, 107.5, 333

[56] References Cited

U.S. PATENT DOCUMENTS

| | | | |
|---|---|---|---|
| Re. 26,902 | 5/1970 | Levenberg | 312/221 |
| 2,829,021 | 4/1958 | Wolters | 312/218 |
| 3,371,974 | 3/1968 | Vermeersch | 312/218 |
| 3,378,321 | 4/1968 | Frederick et al. | 312/215 |
| 3,404,929 | 10/1968 | Wright et al. | 312/216 |
| 3,799,638 | 3/1974 | Falks | 312/216 |
| 3,870,387 | 3/1975 | Mortashed | 312/218 |
| 3,909,090 | 9/1975 | Breckner et al. | 312/217 |
| 3,941,441 | 3/1976 | Scheerhorn | 312/215 |
| 3,969,008 | 7/1976 | Pergler | 312/221 |
| 4,298,236 | 11/1981 | Laroche | 312/217 |

*Primary Examiner*—Victor N. Sakran
*Attorney, Agent, or Firm*—Varnum, Riddering, Wierengo & Christenson

[57] ABSTRACT

A file cabinet (10) including slidably mounted drawers (18) is provided with an interlock mechanism which prevents the simultaneous opening of two drawers. The interlock mechanism includes an elongate channel (24) having a fixed length and depth. Slidable within the channel (24) along the length thereof are blocks (42) and wedges (44). The blocks (44) include at least one end surface (48) which is at an acute angle relative to the bottom wall (28) of the channel (24). The wedge members (44) are displaceable relatively into and out of the depth of the channel. The wedge members have surfaces (52) complementary to and in sliding contact with the end surfaces (48) of the blocks. The length of the channel (28) is less than that of the combined length of all of the block (42) and wedge members (44) disposed therein and at least as long as the combined length of the block and one of the wedge members. A cam means and actuator therefor (55) is mounted on the cabinet so as to displace the wedge members (44) into and out of the channel. When one drawer is opened, the actuator (58) displaces the cam (56) so as to force one of the wedge members (44) into the channel. Displacement of the wedge member (44) causes sliding movement between the blocks (42) and wedge members (44) to a position where the combined length of the blocks and wedge members is equal to the length of the channel (24). In this way, a second drawer cannot be opened since there is no room for further relative movement of the blocks and wedge members.

14 Claims, 8 Drawing Figures

DRAWER INTERLOCK SYSTEM

BACKGROUND OF THE INVENTION

1. Field of the Invention

This invention relates to a filing cabinet including an interlock mechanism which prevents the simultaneous opening of two drawers.

2. State of the Prior Art

Filing cabinets and the like which contain two or more drawers are often used to store heavy files or other materials. In some instances, the opening of two drawers in such a cabinet at one time may cause the cabinet to topple over and possibly cause serious injury to someone. In order to prevent the simultaneous opening of two drawers of such a cabinet and thereby prevent tipping of the cabinet, cabinets have been provided with interlock mechanisms which prevent a second drawer of a cabinet from being opened after a first drawer is opened.

One form of an interlock system used to prevent the simultaneous opening of drawers includes a ribbon or cable which is connected between the drawers and a support on the frame of the cabinet. The cable has a predetermined slack which is taken up when a drawer is fully extended. Interlock systems of this type are shown in the Scheerhorn U.S. Pat. No. 3,941,441, issued Mar. 2, 1976, the Levenberg U.S. Pat. No. Re. 26,902, issued May 26, 1970, the Frederick U.S. Pat. No. 3,378,321, issued Apr. 16, 1968, the Faiks U.S. Pat. No. 3,799,638, issued Mar. 26, 1974.

Another form of interlock system for a filing cabinet uses a mechanical interference to prevent the opening of a second drawer in a cabinet. For example, the Pergler U.S. Pat. No. 3,969,008, issued July 13, 1976, discloses a file cabinet including a safety latch having vertical latch bars and rollers which cooperate with cam members carried on the sides of drawers. When the drawer is moved, the cam member is displaced towards the roller so that the roller engages a cam surface on the latch bar and displaces the latch bar. The latch bar is then maintained in a displaced position to resist movement of a second drawer.

The Wright et al U.S. Pat. No. 3,404,929, issued Oct. 8, 1968, discloses an interlock system having vertically shiftable lock bars including pins which engage cam members. As a drawer is pulled out, the pin enters a slot in the cam member to displace the attached bars. When the bars are in the displaced position, the pins abut a solid face on the cam members to prevent opening of a second drawer.

The Mortashed U.S. Pat. No. 3,870,387, issued Mar. 11, 1975, discloses a cabinet wherein the drawers include channels which receive rollers secured to a vertically shiftable bar carried on the sides of the cabinet. When one drawer is opened, the roller displaces the vertical bar so that the rollers on the remaining drawers and the channels on the bar are no longer in registry. This prevents opening of a second drawer.

Another type of interlock system includes straps on the back surfaces of the drawers which engage vertical bars having corresponding locking portions. The vertical bars engage the strap at the back of the cabinet to prevent opening of the drawer when a first drawer is opened. This type of interlock is shown in the Vermeersch U.S. Pat. No. 3,371,974, issued Mar. 5, 1968.

SUMMARY OF THE INVENTION

In accordance with the invention, a file cabinet or the like includes at least two drawers which are slidably mounted to the cabinet by means of drawer guides. The cabinet includes an interlock mechanism which prevents the simultaneous opening of two drawers within the cabinet. The interlock mechanism includes an elongate channel which is mounted to the cabinet adjacent the drawers. The channel includes a bottom wall and and has a fixed length and depth. Slidable within the channel along the length thereof is at least one block which includes at least one end surface at an acute angle relative to the bottom wall of the channel. Also slidable within the channel are at least two wedge members which are displaceable relatively into and out of the depth of the channel in a direction perpendicular to the elongate length of the channel. One of these wedge members is disposed adjacent an end of the at least one block whereas the second wedge member is disposed adjacent another end of the at least one block. Each of the wedge members has a surface complementary to and in sliding contact with the end surfaces of the block.

The channel has a fixed length which is less than the combined length of all of the block and wedge members disposed therein but at least as long as the combined length of the block and one of the wedge members. In this way, sliding movement of the block and wedge members within the channel is permitted.

Mounted on the cabinet adjacent the drawers and in contact with each of the wedge members in the channel are cam means which displace the wedge members between first and second positions into and out of the channel. The cam means is displaced by actuator means which are cooperatively mounted between the drawers and the cam. The actuator means moves the cam means between the first and second positions upon opening of the drawer. When one of the drawers is opened, the actuator means displaces the cam means from the first to the second position so as to force one of the wedge members into the channel. In this way, the sliding movement between the block and wedge members over the surfaces thereof displaces the block and wedge members along the length of the channel to a position wherein the combined length of the block and wedge members is equal to the fixed length of the channel. Thus, when one of the drawers is opened, a second drawer cannot be opened since there is no room for further relative movement of the block and wedge members within the channel.

The actuator means which displaces the cam means includes a fork or engagement member which is pivotably secured with the cam and rotatable therewith. The fork receives a pin which extends from the drawer so that as the drawer is opened, the pin rotates the fork or engagement member and the attached cam.

In one embodiment of the invention, the cabinet includes vertically-arranged drawers and the elongate channel is vertically oriented and adjacent the sides of the drawers. The fork or engagement member is pivotably mounted to the channel so that the pin extends from the side wall of a drawer so as to rotate the fork and the attached cam. This rotation causes the cam to travel over the top surface of the wedge member and displace the wedge into the channel.

In another embodiment of the invention, the drawers are arranged in side-by-side horizontal relationship with the elongate channel being disposed beneath the drawers. Again, an actuator mechanism as described above which includes a U-shaped or forked member is used to displace the cam and thereby displace the wedge members into the channel. In this embodiment, the cam is mounted adjacent the side walls of the drawer and rotatably secured with the forked member which receives a pin on the side of the drawer. Rotation of a cam in turn displaces a follower which is vertically displaceable in a guide secured to the cabinet. The follower includes a projection which extends into the channel so as to bear against a wedge member. In this way, opening of the drawer forces the wedge member into the channel so as to displace the block and wedge members and take up the slack therebetween to prevent opening of a second drawer.

In a further embodiment, one drawer may be placed in a vertical relationship relative to the drawers arranged in a side-by-side relationship. This embodiment is similar to that described above but also includes a pair of vertically-arranged followers each of which is actuated by a separate cam member. When the top drawer is opened, the adjacent cam forces the respective follower downwardly which in turn displaces the lower follower into the channel. Displacement of the lower follower causes the wedge member to be forced into the channel above, and thereby spread the block and wedge members to take up the slack therebetween.

BRIEF DESCRIPTION OF THE DRAWINGS

The invention will be described with reference to the accompanying drawings wherein like members bear like reference numerals in which.

DETAILED DESCRIPTION OF THE PREFERRED EMBODIMENT

Figure 1:
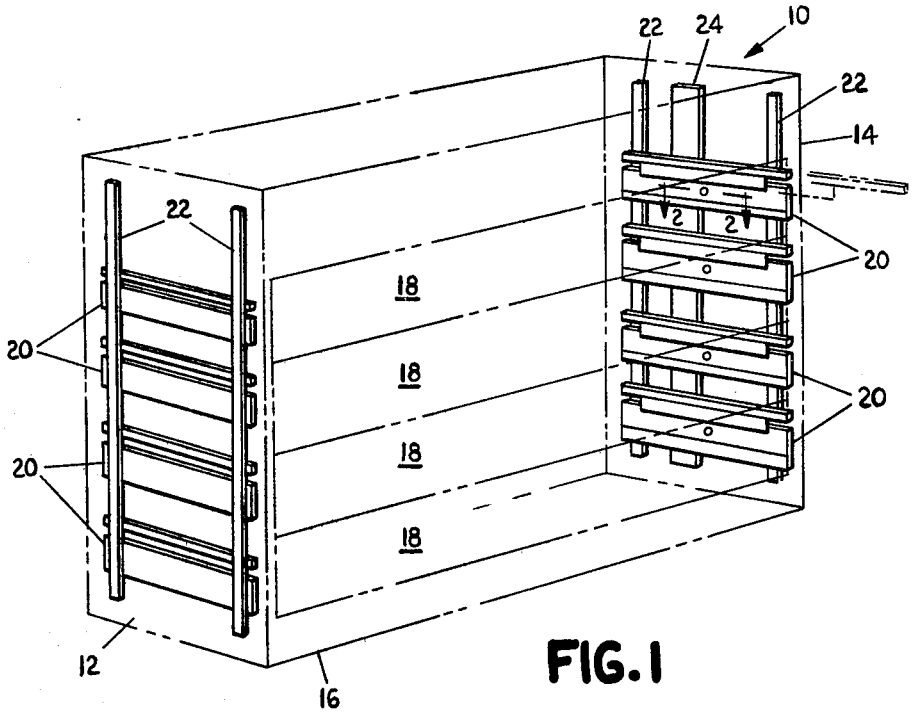
FIG. 1 is a perspective view of a first embodiment of the filing cabinet including an interlock system in accordance with the invention.

With reference to FIGS. 1-4, a first embodiment of an interlock system for a cabinet is shown. As shown in FIG. 1, a filing cabinet 10 or the like includes walls 12 and 14 and a base 16. Slidably mounted within the cabinet 10 are drawers 18 which are slidable on conventional drawer guides 20 secured to the side walls 12 and 14 of the cabinet and the drawer. The drawer guides 20 are mounted to the cabinet 10 by means of a frame 22. By mounting the guides 20 to the frame 22 the drawer guides and the interlock mechanism to be described below may be mounted to the side walls of the cabinet in a relatively easy fashion. Alternatively, the guides and interlock mechanism may be mounted directly to the walls.

Mounted to the drawer guides 20 is an elongate channel 24 which forms part of the interlock mechanism in accordance with the invention. The elongate channel 24 may be stamped or fabricated from sheet metal or the like or may be made of plastic. The elongate channel 24 is mounted to the guides 20 and spaced therefrom by a plate 26.

The channel 24 has a shallow U-shaped configuration having a central web 28 and legs 30, so that the channel has a fixed depth. Extending from one of the legs 30 is a flange 32 which is parallel to the central web 28. The channel 24 is secured to the drawer guides 20 by screws 34 which extend through the spacer 26 and the flange 32. The channel 24 has a length approximately equal to that of the combined height of the drawers. At each end of the channel, in the trough formed by the legs thereof, are fixed stop members 36, 37. One of the stop members 36 has an angled surface 38 relative to the central web 28 of the channel whereas the second stop member 37 has a perpendicular surface 40 relative to central web 28. Slidably disposed between the stops 36, 37 are blocks 42 and wedges 44.

The blocks 42 lie between the legs 30 of the channel and have a depth less than that of the channel. Between one leg 30 of the channel and an elongate surface 43 of the blocks are disposed a plurality of spacers 46 which occupy the remaining depth of the channel. The plates 26 disposed along the length of the channel partially enclose the space between the legs 30 so as to maintain the blocks within the channel. Accordingly, the blocks 42 are maintained in a stationary position relative to the depth of the channel 24.

One end of the blocks 42 has an angled surface 48 whereas the opposite end has a generally perpendicular surface 50 relative to the central web 28 of the channel. In sliding contact with the angled surfaces 48 of the blocks 42 are the wedge members 44, each of which has an angled surface 52 complementary to that of the blocks. In this way the wedges 44 are slidable over the blocks 42. The opposite end 53 of the wedges 44 is perpendicular relative to the central web 28 of the channel 24, with the perpendicular end 53 of the wedge 44 abutting a corresponding perpendicular edge 50 on the blocks.

The wedges 44 have a depth less than that of the depth of the channel. In this way, the wedges 44 are slidable relative to the depth of the channel and may be forced deeper into the channel in a manner to be described below.

Displacement of the blocks 42 and wedges 44 described above is accomplished by means of an actuator and cam mechanism 55. A cam 56 is pivotally secured to the channel adjacent the wedges 44. The cams 56 are spacced along the channel so as to be adjacent a portion of the drawers 18. As shown, the cams 56 include a surface 57 of increasing radius to a flat portion 57*a* in engagement with the wedges 44. Rotation of the cam 56 causes displacement of the wedges 44 in the channel, as will be described below. The flat portion 57*a* provides a stop to prevent accidental return of a wedge 44 after being forced into the channel 24 by a cam 56. Rotation of the cams 56 is accomplished by an actuator 58 which is rotatably secured with the cam 56 by a pivot pin 60. The actuator 58 is in the form of a U-shaped or forked member which includes a slot 62 for receiving a pin 64 extending from a wall of the drawer 18. Rotation of the actuator 58 therefore causes a corresponding rotation of the cam 56 which bears against the wedges 44. The manner of operation of the interlock mechanism will be described below.

Figure 2:
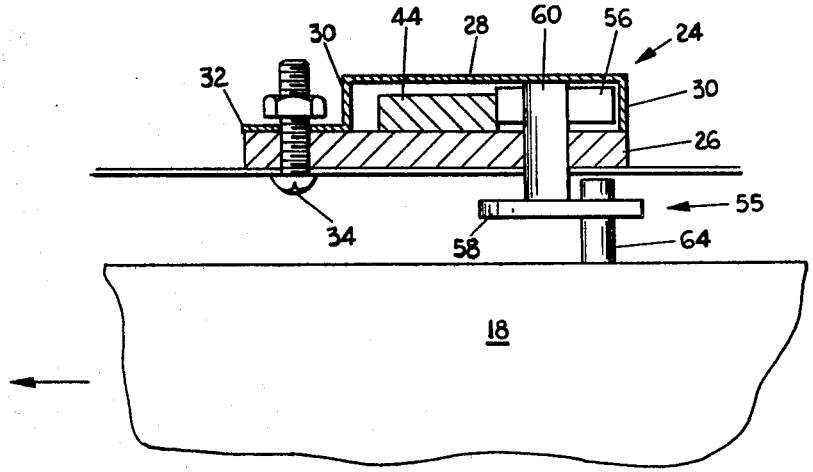
FIG. 2 is a cross-sectional view taken along lines 2—2 of FIG. 1 showing the actuator mechanism and wedge member in accordance with the invention with the drawer in a closed position.
Figure 3:
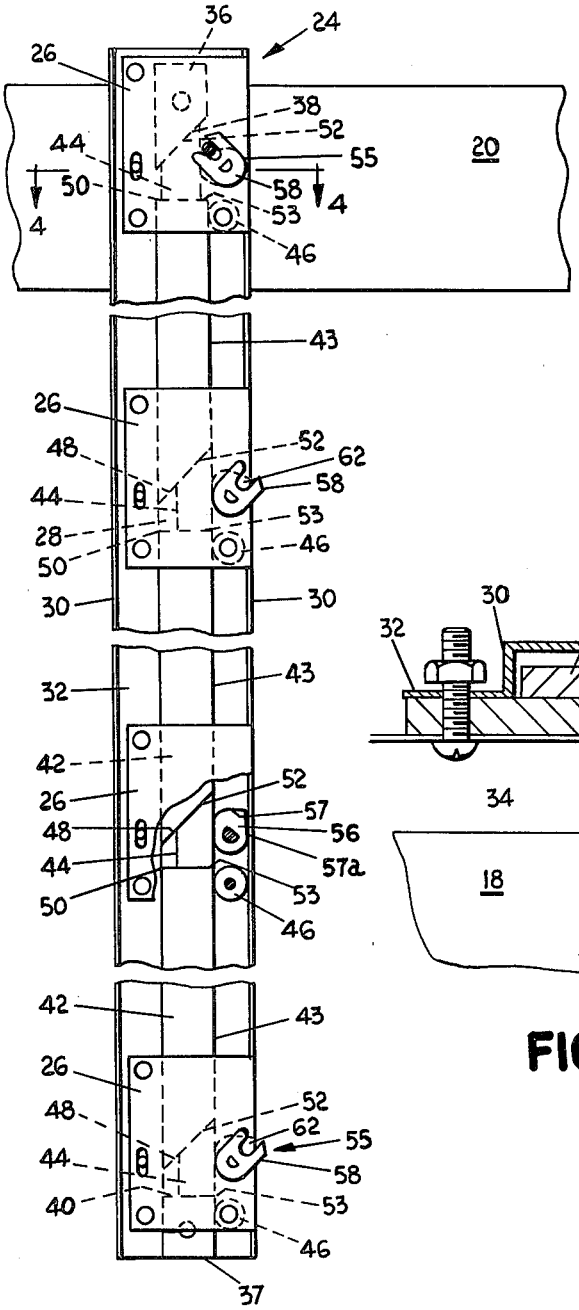
FIG. 3 is a detailed view of the elongate channel including wedge members, blocks and cam members in accordance with the invention.
Figure 4:
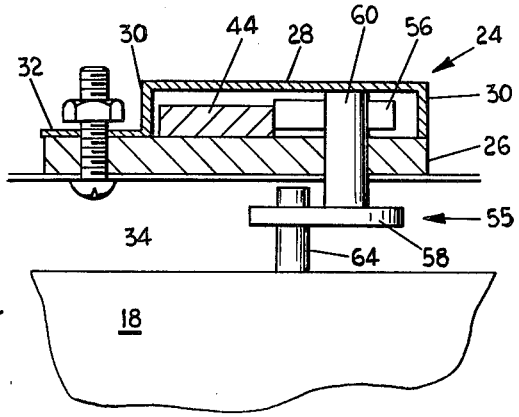
FIG. 4 is a cross-sectional view taken along lines 4—4 of FIG. 3 showing the actuator mechanism and wedge member when a drawer is in the open position.
Figure 5:
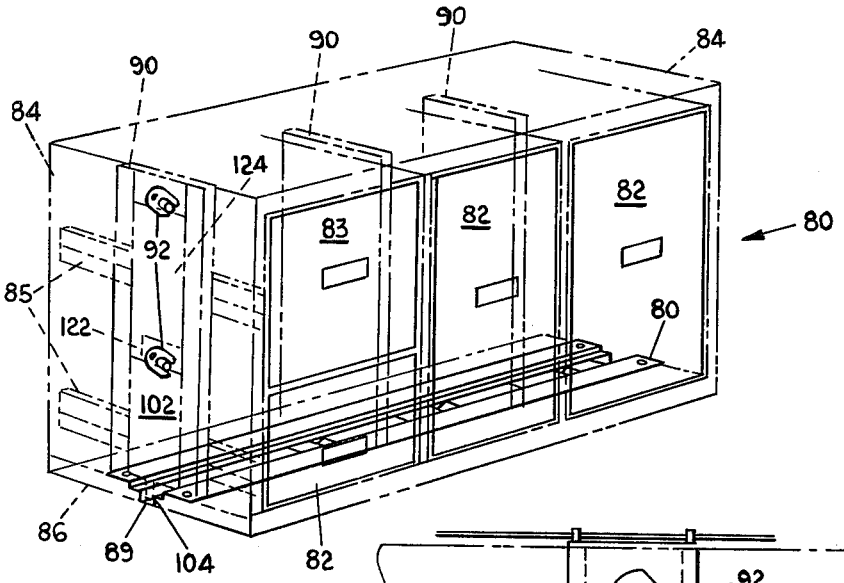
FIG. 5 is a perspective view of a second embodiment of a filing cabinet including an interlock mechanism in accordance with the invention.

As can be seen from FIGS. 1-4, a cam and wedge arrangement is provided for each drawer. When all of the drawers in the cabinet are closed, the cam and wedge arrangements are as shown in FIG. 2. As can be seen, the wedge is spaced from the central web 28 of the elongate channel 24 and there is room for displacement of the wedge 44 within the channel. When the drawer 18 is opened, the pin 64 which extends from a wall of the drawer 18 is received within the slot 62 in the actuator 58. Movement of the drawer 18 rotates the actuator 58 and the attached cam 56. The surface of the cam 57 travels over the wedge 44 so as to force the wedge 44 deeper into the channel 24. Movement of the wedge 44 within the channel 24 causes sliding between the complementary angled surfaces of the wedges 44 and blocks 42 so that the wedges 44 and blocks 42 are displaced towards the end portions of the channel 24. When the drawer is completely opened, the wedge 44 is forced into the channel as shown in FIG. 4. The angled surfaces on the blocks 42 and wedges 44 cause the remaining wedge members to be displaced out of the channel in a direction opposite to that of the wedge 44 which is forced into the channel by the cam 56 so that the remaining wedges 44 bear against the cams 56. Since the channel has a fixed length with stationary stops 36, 37 at each end thereof, the slack in the blocks 42 and wedges 44 is completely taken up so that no displacement of another wedge 44 is possible. Therefore, a second drawer of the cabinet cannot be opened since outward pulling on the drawer would cause the respective cam 56 to bear against the wedge 44 which cannot be displaced within the channel due to the lack of slack between the blocks and wedges.

A second embodiment of an interlock system is shown in FIGS. 5-8 wherein a cabinet 80 including horizontally juxtaposed drawers 82 is shown. The cabinet 80 includes side walls 84 and a base 86. Slidably mounted within the cabinet 80 by means of drawer guides 85 are drawers 82. In addition to the horizontally disposed drawers 82, a drawer which is in a vertical relationship to one of the horizontal drawers 82 may also be mounted in the cabinet.

Disposed beneath the drawers 82 and extending the width thereof is a channel 88 similar to channel 24 described above with reference to the first embodiment. The channel has a U-shaped configuration with a central web 89. Perpendicular to the channel 88 and adjacent the sides of the drawers 82 are guide tracks 90. Each guide track 90 has a shallow U-shaped configuration from which extends a rotatably mounted actuator or forked member 92 similar to that described above. The actuator 92 includes a slot 94 which receives a pin 96 extending from each side of a drawer. Rotatably secured with the actuator by means of a pivot pin 98 is a cam member 100. The cam 100 and actuator 92 are disposed on opposite sides of the guide track 90.

Figure 7:
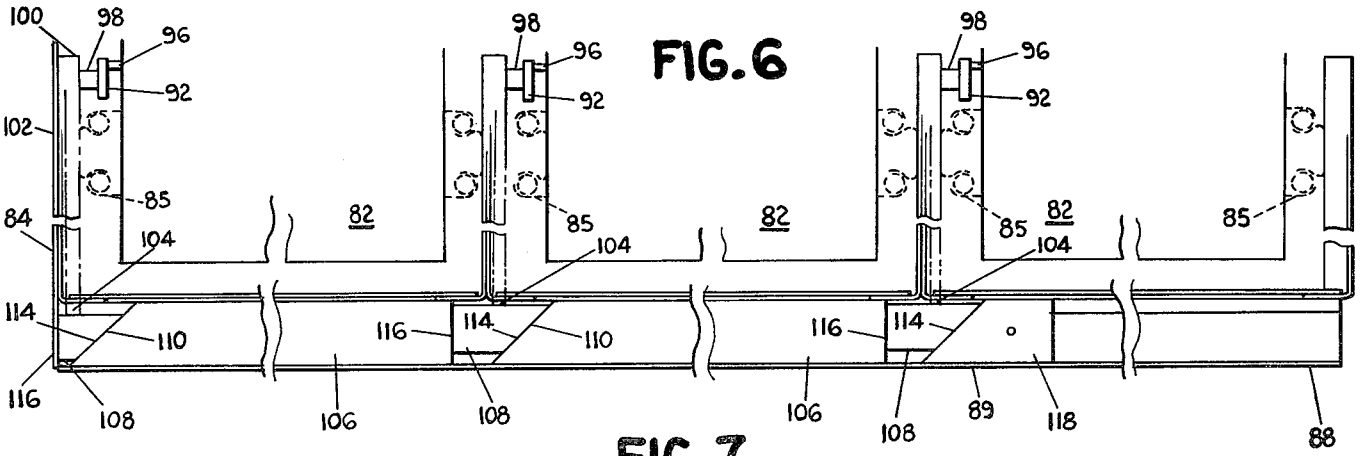
FIG. 7 is a cross-sectional view taken along lines 7—7 of FIG. 6 showing a channel in accordance with the invention.

Slidable within the guide track 90 and vertically displaceable therein is at least one follower 102. The follower 102 is in the form of a generally rectangular block having a projection 104 at the bottom portion thereof. As shown in FIG. 7, the projection 104 bears against a surface of a wedge 108 which is disposed in the channel 88, the operation of which will be described below. As can be seen, rotation of the cam 100 causes the follower 104 to be displaced within the guide track 90.

The channel 88 disposed beneath the drawers 82 is similar to that described above in that it includes a series of blocks 106 and wedges 108 which are slidable therein. The blocks 106 have a polygonal configuration with one end surface 110 angled relative to central web 84 of the channel 88. The other end of the block 106 is generally perpendicular with respect to web 89 of the channel 88.

The wedges 108 slidable in the channel are identical to those described above and include an angled end 114 which is slidable over angled surface 110 of the blocks 106 and an end 116 which is perpendicular to the central web 89 of the channel. In order to fix the length over which the blocks 106 and wedges 108 are slidable in the channel, an adjustable wedge 118 is mounted at one end thereof. The adjustable wedge 118 is adjustable in the channel so as to abut the adjacent wedge 106 so as to limit horizontal displacement of the blocks and wedges when a drawer is opened. The channel 88 abuts the wall 84 of the cabinet at the end opposite that at which the adjustable wedge 118 is mounted to likewise limit horizontal displacement of the blocks and wedges. As can be seen, the blocks 106 and wedges 108 are alternatively arranged with one wedge 108 disposed beneath a follower 104 of each drawer 82. Accordingly, for a two drawer system, two slidable wedges 108 and one slidable block 106 are mounted within the channel 88. For a three drawer system, there are two blocks 106 and three wedges 108, one wedge for each drawer.

Figure 8:
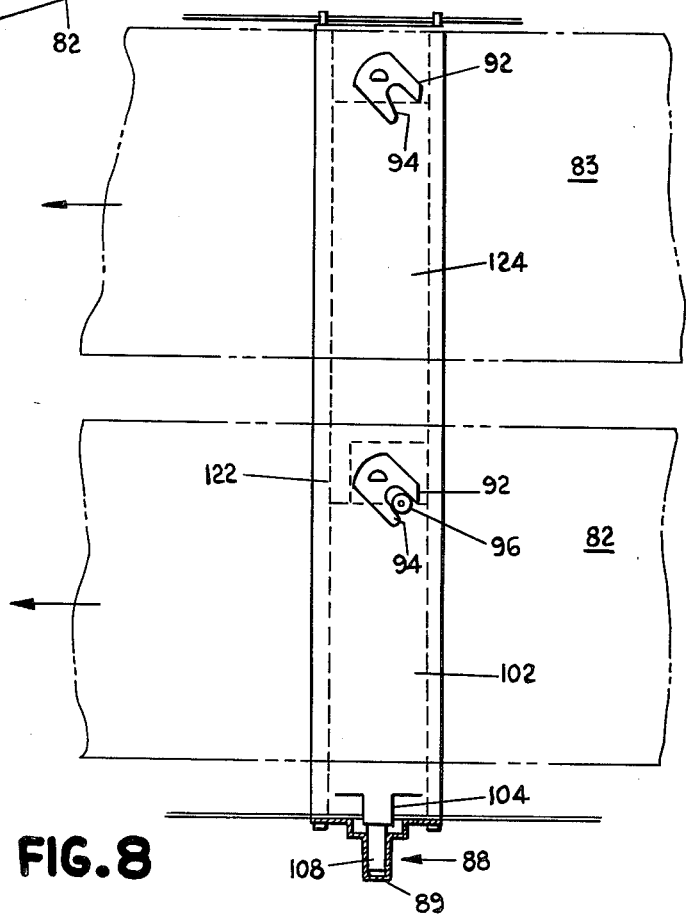
FIG. 8 is an end view of the filing cabinet of FIG. 5 with the side wall removed showing the cam and follower arrangement and the elongate channel in accordance with the invention.
Figure 6:
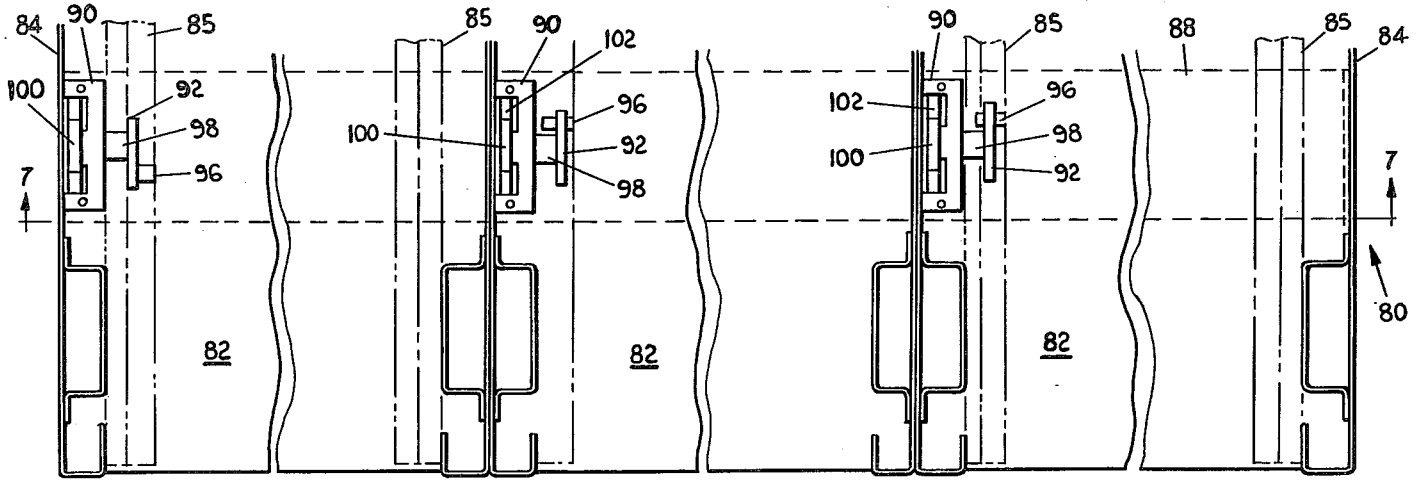
FIG. 6 is a top view of the filing cabinet of FIG. 5 with the top surface removed.

With reference to FIG. 8, the cabinet may include a vertical drawer 83 in addition to the horizontally disposed drawers 82. In this embodiment a second cam and follower arrangement is disposed in the guide track 90 with the follower vertically disposed over the follower 102 of the lower drawer. The actuator and cam arrangement is the same as that described above. The upper follower 124 includes a projection 122 which bears against the top surface of the lower follower 102. Accordingly, as the top drawer 83 is opened the cam 100 forces the upper follower 124 downwardly so that the projection 122 in turn urges the follower 104 adjacent the lower drawer 82 downwardly towards the channel 88 to thereby displace the wedge 108 therein.

In operation, as one of the drawers 82 of the cabinet is opened, the pin 96 which extends from the side of the drawer 82 is received in the slot 94 on the actuator 92 or forked member to thereby rotate the actuator 92. Rotation of the actuator 92 rotates the attached cam 100 which travels over the top surface of the adjacent follower 102. The configuration of the cam 100 therein forces the follower 102 downwardly so that the projection 104 on the bottom thereof urges against the top of the wedge 108 which is spaced from the central web 89 of the channel. In this way, the wedge 108 is displaceable downwardly in the channel. Downward displacement of the wedge 108 in the channel 88 causes relative sliding between the blocks 106 and wedges 108 over the angled surfaces 110, 114 thereof so as to spread the blocks 106 and wedges 108 toward the ends of the channel. With reference to FIG. 7, the drawer at the farthest left is shown in the open position with the cam 100 rotated and the follower 102 forced downwardly to force the corresponding wedge 108 into the channel.

The displacement of the wedge 108 in the channel causes the remaining wedges 108 to ride upwardly in the channel so as to bear tightly against the projections 104 on the followers 102. In this way, a second drawer in the cabinet cannot be opened since there is no room for further sliding of the wedges 108 and blocks 106. Any attempt to open a second drawer 82 is blocked since the downward movement of the follower 102 would be resisted by the wedges 108 which are held firmly in place.

When the system is used in a cabinet including vertically-arranged drawers as in FIG. 8, opening of the upper drawer 83 rotates the actuator 92 and cam 100 so as to force the upper follower 124 downwardly which in turn displaces the lower follower 102. The remaining operation of the drawer is as described above with the follower 102 displacing the wedge 108 in the channel so as to force the wedges 108 and blocks 106 outwardly and take up the slack therebetween.

The above-described interlock mechanisms for filing cabinets or the like provides a relatively simple means for preventing the opening of more than one drawer in the cabinet. The channels including the blocks and wedges may be assembled in components so that a number of such assemblies including channels of a specified length may be mounted in a cabinet depending upon the number of drawers in the cabinet. It is only necessary to provide one wedge for each drawer along with one actuator and cam mechanism. Also, assembly of the cabinet including such an interlock mechanism is relatively easy in that the channels, either vertically or horizontally arranged, are mounted to the cabinet walls. This is in distinction to cable interlock systems wherein the cable must be secured to cams or other stop members onto the cabinet as well as to drawers. Additionally, the use of rigid members as opposed to cables or the like may provide a more durable interlock system in that the probability of the parts failing is minimal.

The foregoing and description of drawings are merely illustrative of the invention and are not intended to limit the invention to the above-described embodiments. Variations and changes which may be obvious to one skilled in the art may be made without departing from the scope and spirit of the invention as defined in the appended claims.

The embodiments of the invention in which an exclusive property or privilege is claimed are defined as follows:

1. In a cabinet including a housing, at least two drawers, means slidably mounting said drawers to the housing and an interlock mechanism for preventing the simultaneous opening of two drawers, the improvement in said interlock mechanism comprising:

an elongate channel mounted to said housing adjacent said at least two drawers, said channel having a fixed length and depth and including a bottom wall;

at least one block slidable in said channel along the length thereof, said at least one block including at least one end surface at an acute angle relative to the bottom wall of the channel;

at least two wedge members slidable relatively into and out of said channel in a direction perpendicular to the length of the channel;

one of said wedge members disposed adjacent an end of said at least one block and a second of said at least two wedge members disposed adjacent another end of said at least one block;

each of said wedge members having a surface complementary to and in sliding contact with the end surfaces of said at least one block;

the fixed length of said channel being less than the combined length of said block and wedge members but at least as long as the combined length of said block and one of said wedge members;

cam means mounted on said housing adjacent said drawer and in contact with each of said wedge members for displacing one of said wedge members between a first position relatively in said channel and a second position relatively out of said channel;

actuator means cooperatively mounted between the drawers and the cam means for moving said cam means between said first and second positions upon opening of one drawer;

whereupon opening of one of said drawers said actuator means moves said cam means between said first and second positions so as to force one of said wedge members relatively into said channel so that the at least one block and the wedge members are displaced along the length of the channel to a position wherein the combined length of the block and wedge members is equal to the fixed length of the channel, thereby blocking any further movement of the wedge members in the channel to prevent the opening of a second drawer.

2. The cabinet of claim 1 wherein said actuator means includes an engagement member secured to said cam means and rotatable therewith and a pin extending from said drawer, wherein said pin is received by said engagement member upon opening and closing of said drawer to thereby rotate said cam means.

3. The cabinet of claim 2 wherein said engagement member is a U-shaped member pivotably secured to said channel.

4. The cabinet of claim 1 wherein said channel includes stop members secured at ends thereof so as to define the fixed length of the channel.

5. The cabinet of claim 3 wherein said drawers are arranged in a vertically-stacked relationship and said elongate channel is vertical.

6. The cabinet of claim 5 wherein said actuator means includes a U-shaped member secured with said cam means and rotatable therewith and a pin extending from a side wall of the drawer which is received by the U-shaped member upon opening and closing of the drawer.

7. The cabinet of claim 6 wherein said cam means includes a cam surface which travels over a surface of said wedge members upon opening of one drawer to thereby displace said wedge member relatively into said channel.

8. The cabinet of claim 1 wherein said drawers are arranged in a side-by-side horizontal relationship and said elongate channel is disposed beneath said drawers.

9. The cabinet of claim 8 wherein said actuator means includes a U-shaped member which is secured to said frame and a pin extending from the side wall of the drawer which is received by the U-shaped member upon opening and closing of the drawer.

10. The cabinet of claim 9 wherein said cam means includes a cam member secured with said U-shaped member and rotatable therewith and a follower which is vertically displaced by said cam member upon opening and closing of said drawer, said follower being vertically displaceable in a guide secured to said housing.

11. The cabinet of claim 10 wherein said follower includes a projection which bears against said wedge member so as to force said wedge member relatively into said channel upon opening of the drawer.

12. The cabinet of claim 8 further including a drawer arranged in a vertical relationship relative to one of said at least two drawers arranged in a side-by-side horizontal relationship.

13. The cabinet of claim 12 including cam means adjacent each of said vertically-arranged drawers.

14. The cabinet of claim 13 wherein said cam means includes a cam member secured with said actuator means and rotatable therewith and a follower vertically displaced in a guide on said housing by said cam member so that the followers of both of the vertically-arranged drawers are disposed in a vertically-stacked relationship, whereupon opening of the upper drawer of said vertically arranged drawers causes said adjacent cam means to displace said vertically stacked followers and thereby force said wedge relatively into said channel.

* * * * *